US006088831A

United States Patent [19]

Jensen et al.

[11] Patent Number: 6,088,831

[45] Date of Patent: Jul. 18, 2000

[54] PEACE OFFICER'S UNIFORM WITH GEAR SUPPORT

[76] Inventors: Derek L. Jensen, 12005 San Antonio Rd., Atascadero, Calif. 93422; Desmond J. Fitzgerald, 7621 Firestone Blvd. #A-4, Downey, Calif. 90241

[21] Appl. No.: 09/290,565

[22] Filed: Apr. 13, 1999

[51] Int. Cl.[7] ..... F41H 1/02

[52] U.S. Cl. ..... 2/2.5; 2/94; 2/117; 2/908; 2/229

[58] Field of Search ..... 2/69, 2.5, 94, 455, 2/463, 467, 456, 227, 102, 113–115, 117, 78.4, 908, 92, 920, 229, 120, 309; 224/904

[56] References Cited

U.S. PATENT DOCUMENTS

| | | | |
|---|---|---|---|
| 965,596 | 1/1910 | Pell | 2/78.4 |
| 1,249,108 | 12/1917 | Jones | 2/78.4 |
| 2,562,234 | 7/1951 | Gottschalk | 2/117 |
| 4,697,285 | 10/1987 | Sylvester | 2/2.5 |
| 5,054,127 | 10/1991 | Zevhak | 2/227 |
| 5,060,314 | 10/1991 | Lewis | 2/2.5 |
| 5,123,120 | 6/1992 | Ross | 2/229 |
| 5,182,812 | 2/1993 | Goldsby | 2/227 |
| 5,303,860 | 4/1994 | Serafini | 224/904 |
| 5,441,185 | 8/1995 | Dragos | 224/904 |
| 5,488,738 | 2/1996 | Seamans | 2/69 |
| 5,495,621 | 3/1996 | Kibbee | 2/2.5 |
| 5,717,999 | 2/1998 | Lurry | 2/227 |
| 5,754,982 | 5/1998 | Gainer | 2/2.5 |

FOREIGN PATENT DOCUMENTS 2691331 11/1993 France .

*Primary Examiner*—John J. Calvert
*Assistant Examiner*—Tejash Patel
*Attorney, Agent, or Firm*—Edgar W. Averill, Jr.

[57] ABSTRACT

A uniform for peace officers and others requiring the wearing of body armor which uniform supports heavy gear around the wearer's waist. The uniform includes body armor which has front and rear parts which are supported over the wearer's shoulders by shoulder straps. The body armor has hook portions of hook and loop fasteners affixed to the outer surface adjacent that part of the body armor which is under a wearer's belt. A shirt has loop fasteners attached to the inner surface and hook fasteners attached to the outer surface adjacent that portion of the shirt which is under a wearer's belt. Lastly, pants are provided which have eye type fasteners around the inner portion of the waist and belt loops around the outer portion. When a uniform is worn with a duty belt supporting heavy gear, the duty belt is supported by keepers which hold the duty belt to the pants belt which is supported by the belt loops which in turn are supported by the hook and eye fasteners directly to the body armor which in turn which is supported by its shoulder straps. Alternatively, the body armor may be worn above the belt in which case the shirt helps to support the weight of the duty belt.

7 Claims, 5 Drawing Sheets

10
16
11
19
15
13
14
14'
13'
15
17
18
18'
20
12

10
16
11
19
15
13
14
14'
13'
15
17
18
18'
20
12

PEACE OFFICER'S UNIFORM WITH GEAR SUPPORT

BACKGROUND OF THE INVENTION

The field of the invention is uniforms for those required to wear body armor. This could, of course, be military personnel, peace officers, security personnel and various government enforcement agencies and the like. A problem which is most common with peace officers is the necessity to wear heavy gear. Duty or utility belts are most commonly worn by peace officers. These belts are used to hold the necessary gear that a peace officer uses which typically include a firearm and holster, handcuffs in a handcuff case, an ammunition case, a baton, a flashlight, pepper spray, a knife and a tape recorder. This equipment can collectively weigh between 8 and 13 pounds. The duty belt is held to the pants belt by keepers which pass under the pants belt and snap over the duty belt transferring the weight on the duty belt to the pants belt. This weight supported by a wearer's belt through the keepers can place a strain on the lower back and hips of the officer. Furthermore, the weight of such gear continuously pulls downwardly on the wearer's belt and can cause the duty belt to move downwardly from its preferred location.

Peace officers, and especially police officers, commonly wear body armor which covers the front and back of the officer. The front and back portions of the body armor are typically supported by the wearer's shoulders and side straps are used, typically with hook and eye fasteners, to secure the front and back parts of the body armor to the wearer. The body armor being somewhat bulky can add to the weight support problem since the portions of the gear along the back portion of the wearer's belt tends to press into the user's back while sitting, such as in an automobile, and if the belt has worked its way below an ideal location this can press the gear against the wearer's lower back and exacerbate the potential of back problems. When the duty belt is at the preferred location, this gear is above the portion of the back which is particularly sensitive to continued pressure.

Hook and eye fasteners have been used in place of suspenders in garments as shown in U.S. Pat. No. 5,488,738. In this patent a vest supports a suspenders-like member which in turn fastens to a lower body garment. It is suggested for use by elderly persons.

U.S. Pat. No. 5,495,621 shows a body armor vest which includes an elastic lower garment. The lower garment anchors the vest in place by attaching along a strip across the front and back of the vest at the waist.

BRIEF SUMMARY OF THE INVENTION

It is an object of the present invention to provide a peace officer's uniform which will maintain the duty belt in a preferred position.

The present invention is for a uniform for peace officer's wearing body armor. The uniform has a shirt having outer front and rear fastening members. The pair of pants has a waist portion with belt loops on the outer waist portion and pants fastening members secured to the inner waist portion. A duty belt is held to a pants belt which in turn is held by belt loops on the pants. The duty belt is required to support a substantial weight of gear and is prevented from working its way downwardly by the attachment of the fastening member on the inner waist portion of the pants to the fastening member on the shirt. Also, the body armor may contain a fastening member which secures it to the shirt. The shirt has fastening members which secure both to the body armor and to the pants which, thus, transfers the weight on the duty belt to the body armor and from there to the wearer's shoulders.

DESCRIPTION OF THE PREFERRED EMBODIMENTS

Figure 1:
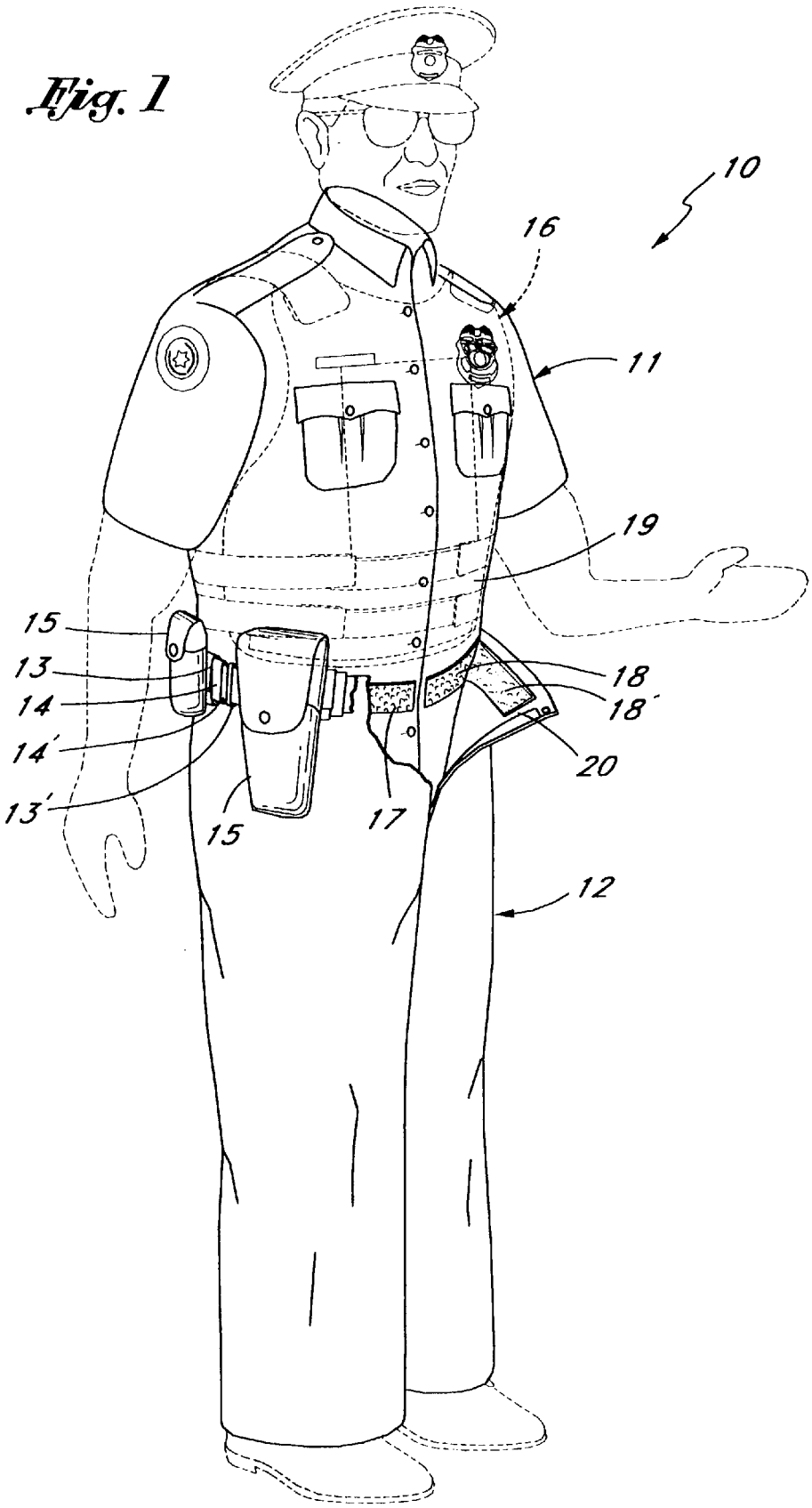
FIG. 1 is a front and right side view of a peace officer wearing the uniform with gear support of the present invention showing body armor in hidden lines above the officer's belt.

A uniform for peace officers is shown in FIG. 1 and indicated generally by reference character 10. Uniform 10 has a shirt 11 and pants 12. The pants have belt loops 13' which support a pants belt 14'. A duty belt 14 is held onto pants belt 14' by four or so keepers 13 which surround and snap over both the pants belt 14' and the duty belt 14 thereby transferring any weight on the duty belt 14 to the pants belt 14' to the belt loops 13'. Duty belt 14 can hold a surprising amount of gear. For peace officers the gear typically includes a firearm and a holster, handcuffs and handcuff case, an ammunition case, a baton, a flashlight, pepper spray, a knife and a tape recorder. Such equipment typically weighs between 8 and 13 pounds and naturally places a substantial downward force on the duty belt 14 and usually through the keepers 13, to the pants belt 14' and to the belt loops 13'. This gear is indicated generally by reference character 15.

Figure 2:
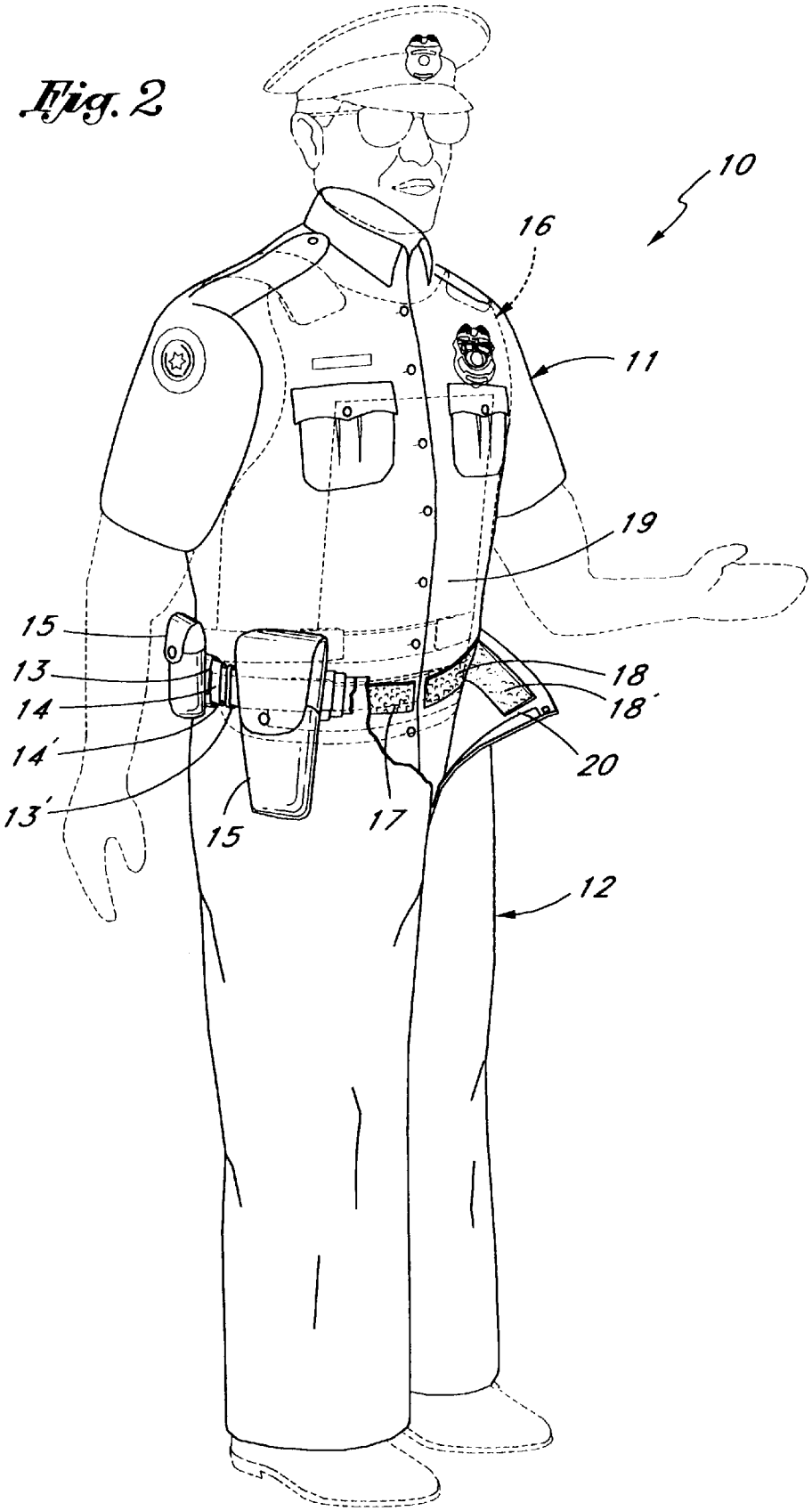
FIG. 2 is a front and right side view of a peace officer wearing the uniform with gear support of the present invention showing body armor in hidden lines supporting the officer's belt.
Figure 7:
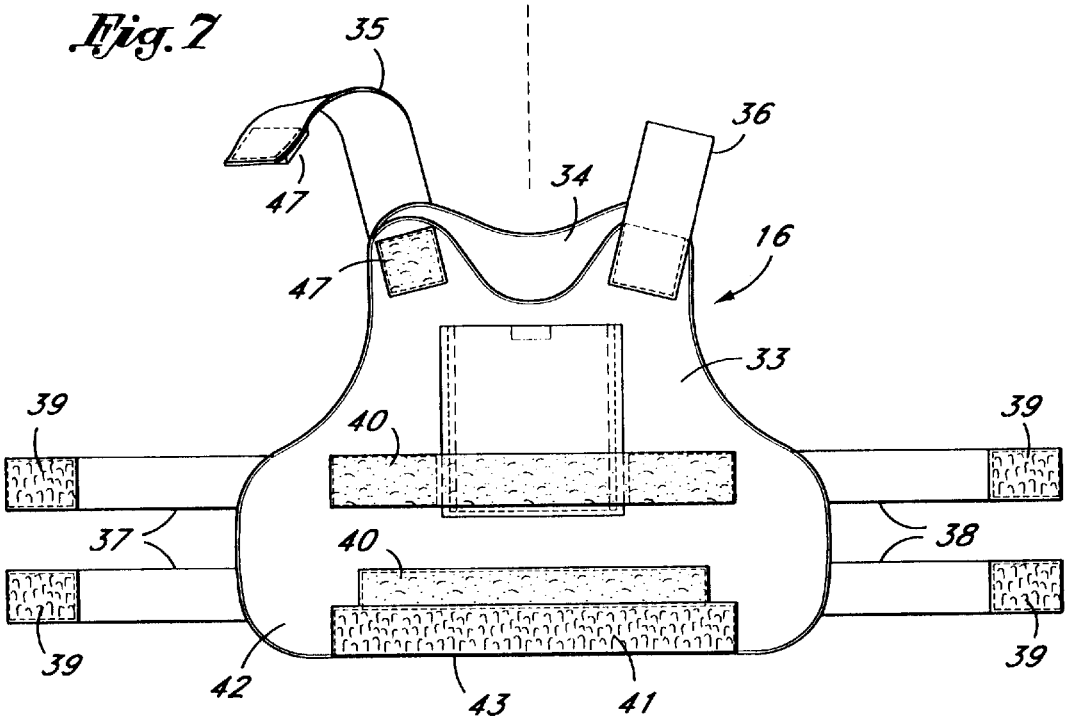
FIG. 7 is a front view of the front and back parts of the body armor thereof.

Body armor 16 is shown in phantom view in FIG. 1 to indicate a first possible relative location with the shirt 11 and pants 12. The body armor is shown in further detail in FIGS. 7 and 8. Body armor 16 may be worn above the pants as shown in FIG. 1 where the shirt 11 carries the weight of the gear 15. Alternatively, the body armor 16 may be worn so that it extends under the belt 14' as shown in FIG. 2. In this configuration, the body armor shoulder straps ultimately support the weight of gear 15 as described below.

As shown in FIG. 1, shirt 11 has hook portions of hook and eye fasteners 17 and 18 sewn to the front 19 of shirt 11. Eye portions 18' are sewn or otherwise affixed to the inner surface of the waist portion 20 of pants 12. Eye portion 18' attaches to hook portion 18 when worn.

Figure 3:
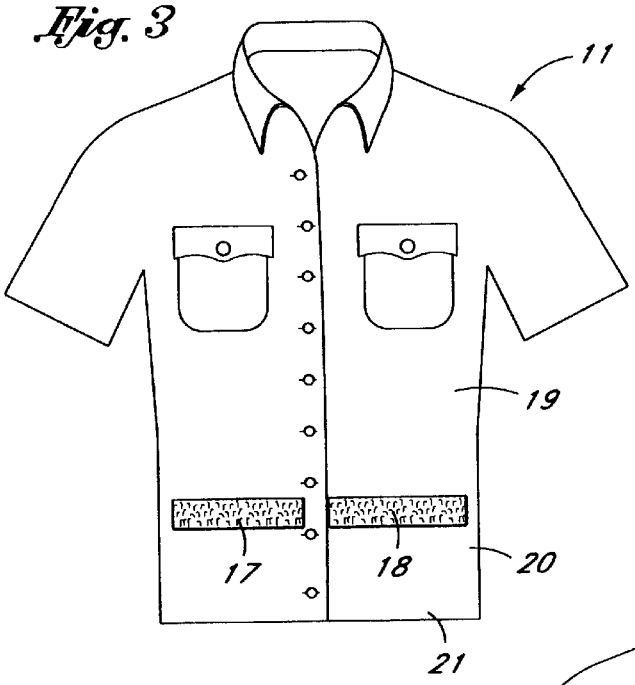
FIG. 3 is a front view of the shirt thereof.
Figure 4:
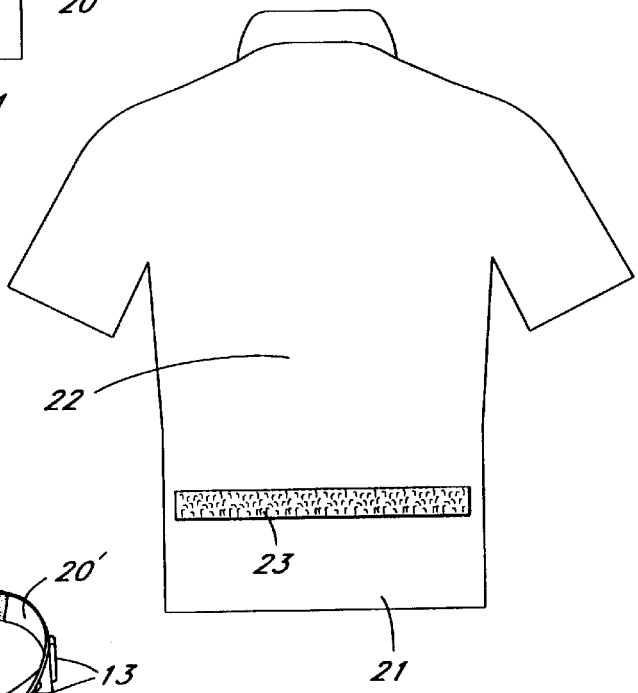
FIG. 4 is a back view of the shirt thereof.

Further details of the shirt are shown in FIG. 3 where shirt 11 has a front 19 which has an outer surface 20 to which shirt outer front fastening members 17 and 18 are affixed. As can be seen in the drawings by the hook representations, fastening members 17 and 18 are hook portions and they are affixed to the tail 21 of the shirt at the belt area as shown in FIG. 1. The back of the shirt 22 is shown in FIG. 4 and can be seen to have a shirt outer rear fastening member 23 which comprises a length of hook portions of such fastener.

Figure 5:
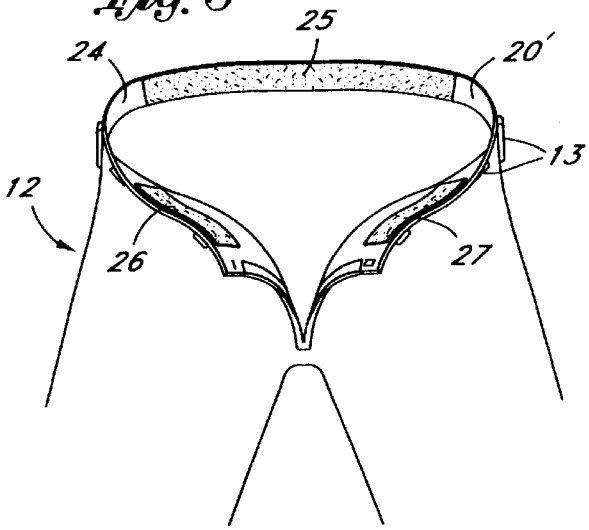
FIG. 5 is a front open view of the pants thereof.

The pants 12 are shown in FIG. 5 and have an inner surface 24 which has an inner waist portion 20'. Pants fastener members 25, 26 and 27 are made of eye portions of the fastening members and are positioned to fasten to the shirt fastening members 17, 18 and 23.

Figure 6:
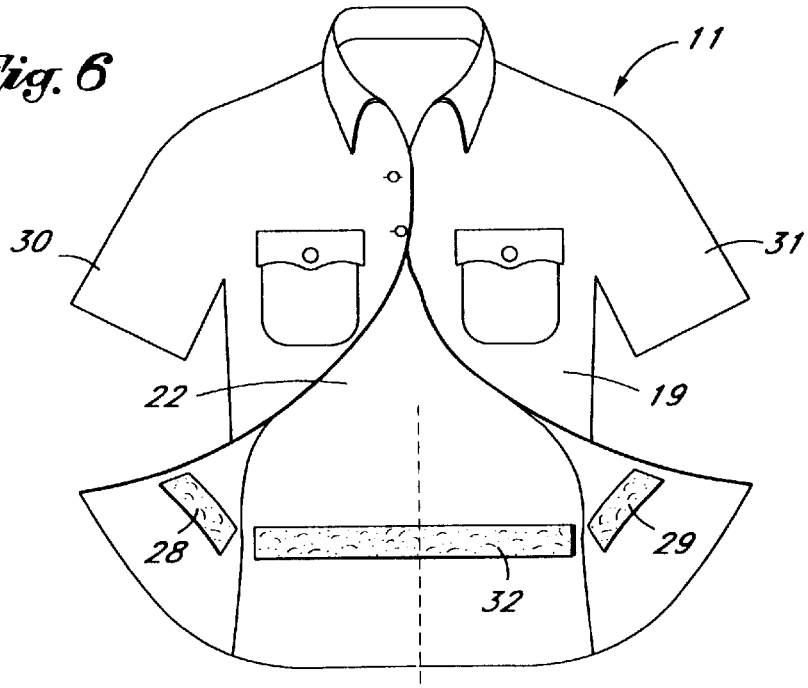
FIG. 6 is a front open view of the shirt thereof.

The shirt is shown in an open view in FIG. 6 where shirt inner front fastening members 28 and 29 can be seen made of eye material and are sewn to the inner surface of the shirt back to back with members 17, 18 and 23. When the body armor is to be worn above the pants, the shirt inner fastening members 28, 29 and 32 are unnecessary. The sleeves of the shirt are indicated a by reference characters 30 and 31.

The body armor is of a conventional design as far as the body armor and shoulder straps are concerned. The body armor is indicated generally by reference character 16 and consists generally of a front part 33 and a back part 34. These parts are supported on the wearer by shoulder straps 35 and 36 and are affixed around the wearer by side straps 37 and 38. The side straps have hook material 39 which attaches to the eye material 40 affixed to the front of front part 33.

Figure 8:
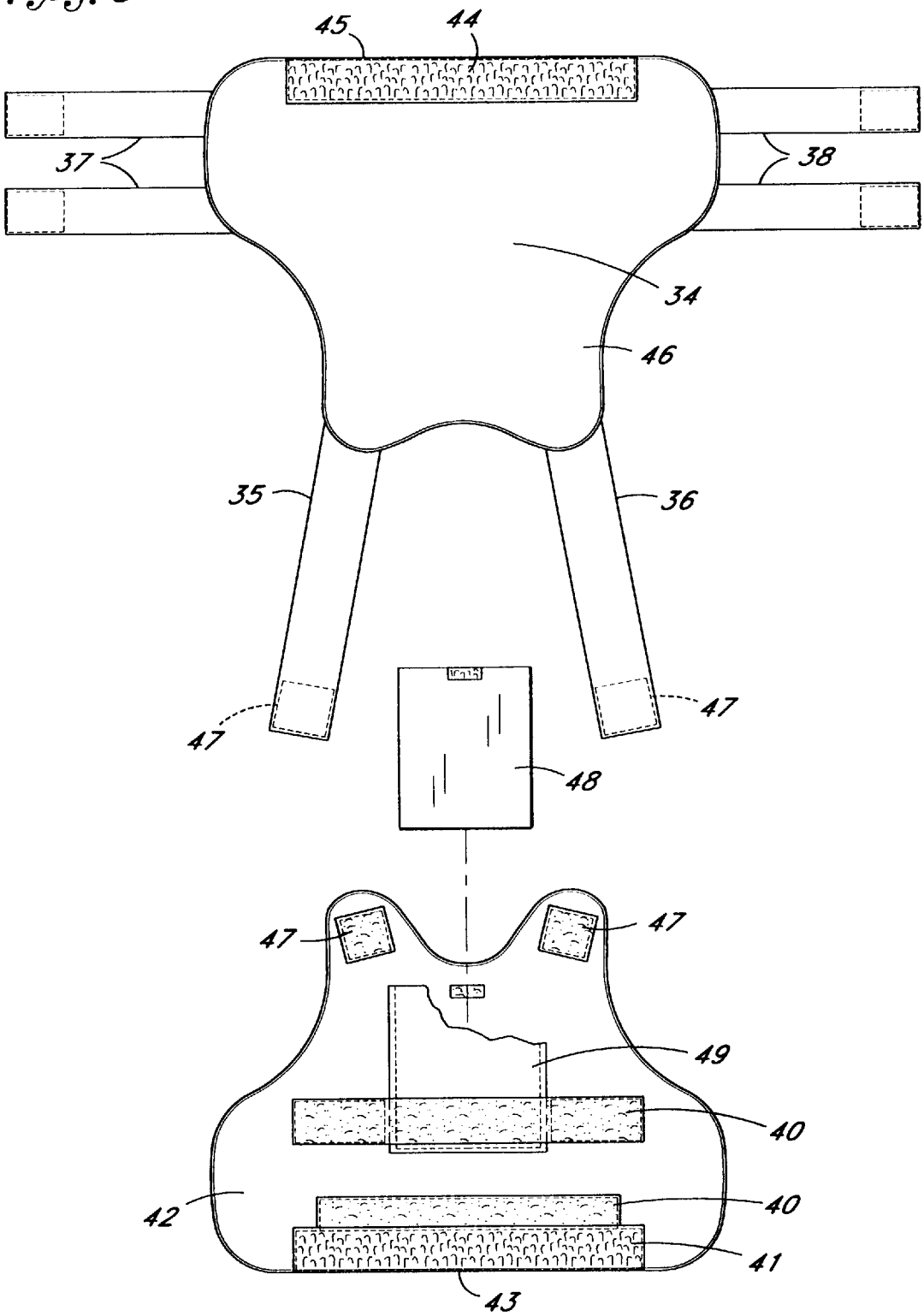
FIG. 8 is an exploded view of the body armor of FIG. 7.

A length of hook portion of front fastening member 41 is affixed to the outer surface 42 of front part 33 at the bottom 43 thereof. A similar length of hook portion is shown in FIG. 8 on the back part 34. This back fastening member is indicated by reference character 44 and is located at the bottom 45 of the back part 34 on the outer surface 46 thereof. Shoulder straps 35 and 36 have hook and eye fastening means 47 to hold the shoulder straps in place and support the body armor. When the body armor is configured to be worn under the belt, the straps 36 support not only the body armor but in turn support the gear 15 as described below. The body armor also has a breast plate 48 which is conventional and fits in a breast plate pocket 49.

Turning now to FIG. 2, body armor 16 extends below the belt line of the officer. As in FIG. 1, the body armor is shown in phantom view in FIG. 2. The fact that the body armor is supported by the wearer's shoulders through straps 35 and 36 can be readily understood. The front fastening member 41 and the back fastening member 44 is not shown in FIG. 2 but can be clearly understood to attach to the shirt inner front fastening members 28 and 29 and to the shirt inner rear fastening member 32. Since these are affixed to the opposite side of the shirt outer fastening members 17, 18 and 23, when the pants fastening members 25, 26, and 27 are secured thereto and a pants belt 14' is placed through the belt loops 13' and a duty belt 14 is secured to pants belt 14' by keepers 13, the gear 15 on the duty belt 14 can be seen to be supported by shoulder straps 35 and 36. In this way the wearer's shirt 11 is not pulled down by the weight of gear 15 but instead is transferred to the body armor 16 which is supported by the user's shoulder which provides a comfortable and secure area of support.

The result is a uniform which helps to hold the body armor 16 in place while at the same time the body armor 16 helps to hold the duty belt 14 in place. The result is a far more comfortable and attractive uniform which will keep the belt in place in spite of many entrances and exits from a motor vehicle. It is believed that the use of the uniform of the present invention will greatly reduce the occurrences of back pain from lot the gear worn by police officers.

While hook and eye type fastening members are described herein it is to be understood that other types of fasteners can also work, but the hook and eye fastening means is the preferred type of fastener at this time. It is appropriate that the inner surfaces of the pants and shirt have the softer eye portions in the event that hook and eye fasteners are used so that this permits the uniform to be worn without body armor in comfort.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A uniform for peace officers and others requiring the wearing of both body amour and a belt supporting heavy gear around the waist, said uniform comprising:

body amour having a front part, a back part, and shoulder straps affixed to an upper portion of the front part and the back part to support the body amour on the shoulders of a wearer, said straps designed to go over the wearer's shoulders and support the front part and the back part over a wearer's chest and back;

a shirt having a front, a back, sleeves, a tail which is worn tucked into a wearer's pants, said shirt having an inner surface and an outer surface and said shirt having a shirt outer front fastening member located on an outer surface of the tail of the shirt;

a pair of pants having a waist portion with belt loops on an outer waist portion and pants fastening members secured to the inner surface of an inner waist portion of said pair of pants;

a pants belt held by said belt loops; and a duty belt held to said pants belt, said duty belt supporting heavy gear, wherein the shirt and pants provide support means for assisting in supporting duty belt and pants belt in combination with the belt loops and by transfering the weight of the heavy gear through the belt loops through the pants to the pants fastening member to the shirt via the shirt front fastening member and rear fastening member to the shoulders.

2. The uniform of claim 1 wherein said fastening members are made of matching hook and loop fastening members and hook portions comprise the shirt outer front and rear fastening members and all other fastening members are made of loop portions.

3. The uniform of claim 2 wherein the pants fastening members are positioned on front and back areas of the inner waist portion of said pair of pants and side areas of the inner waist portion are free from pants fastening members.

4. A uniform for peace officers and others requiring the wearing of both body armor and a belt supporting heavy gear around the wearer's waist, said uniform comprising:

body armor having a front part, a back part, and shoulder straps affixed to an upper portion of the front part and the back part to support the body armor on the shoulders of a wearer, said straps designed to go over the wearer's shoulders and to support the front part and the back part over a user's chest and back, said body armor having a front fastening member secured to an outer surface of the front part and having a back fasting member secured to an outer surface of the back part, said front and back fastening members being located to be surrounded by belt area of the wearer's pants when the peace officer is dressed in uniform;

a shirt having a front, a back, sleeves, a tail which is worn tucked into a wearer's pants, said shirt having an inner surface and an outer surface and said shirt having a shirt inner front fastening member located on an inner surface of the tail of the shirt at the front and an shirt inner rear fastening member located on an inner surface of the tail of the shirt, said shirt front and shirt rear fastening members being securable to the front and back fastening members of said body armor and said shirt having a shirt outer front fastening member located on an outer surface of the tail of the shirt at the front and an outer shirt rear fastening member located on an outer surface of the tail of the shirt; and a pair of pants having a waist portion with belt loops on an outer waist portion and pants fastening members secured to the inner surface of an inner waist portion of said pair of pants whereby when a peace officer is wearing body armor supported on the wearer's shoulders, the shoulder straps of the body armor can support the wearers gear on a wearer's belt because the wearer's belt loops are supported by the pants fastening member, which in turn is supported by the shirt tail inner and outer shirt fastening members which in turn are supported by the body armor front and rear fastening members.

5. The uniform of claim 4 wherein said fastening members are made of matching hook and loop fastening members and hook portions comprise the front and back fastening members on said body armor, the shirt outer front and rear fastening members and all other fastening members are made of loop portions.

6. The uniform of claim 5 wherein the pants fastening members are positioned on front and back areas of the inner waist portion of said pair of pants and side areas of the inner waist portion are free from pants fastening members.

7. The uniform of claim 4 wherein the shirt outer front and rear fastening members are affixed to the shirt back to back with the shirt inner front and rear fastening members.

* * * * *